US006146163A

United States Patent [19]

Wu

[11] Patent Number: 6,146,163

[45] Date of Patent: Nov. 14, 2000

[54] EJECTION MECHANISM FOR ELECTRICAL CARD CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/324,557

[22] Filed: Jun. 2, 1999

[30] Foreign Application Priority Data

Jun. 2, 1998 [TW] Taiwan ..... 87208642

[51] Int. Cl.[7] ..... H01R 13/62

[52] U.S. Cl. ..... 439/159

[58] Field of Search ..... 439/159, 160; 361/684, 754, 756

[56] References Cited

U.S. PATENT DOCUMENTS 5,324,204 6/1994 Lwee ..... 439/159
5,389,001 2/1995 Broschard, III et al. ..... 439/159
5,643,001 7/1997 Kaufman et al. ..... 439/159
5,836,775 11/1998 Hiyama et al. ..... 439/159
5,846,096 12/1998 Ishida ..... 439/159
5,899,763 5/1999 Kajiura ..... 439/159

*Primary Examiner*—Steven L. Stephan
*Assistant Examiner*—Hae Moon Hyeon
*Attorney, Agent, or Firm*—Wei Te Chung

[57] ABSTRACT

An ejection mechanism for ejecting an electrical card from an electrical card connector includes a shell (1) for receiving the electrical card, a push bar (2) positioned on a side of the shell (1), a push plate (5) slidably connected to a base (10) of the shell (1), and a connection plate (3). The connection plate (3) pivots about a positioning silo (33) formed in the base (10) and has a first end (31) engaging with the push bar (2) and a second end (32) engaging with the push plate (5). Thus, the electrical card can be easily ejected from the electrical card connector by exerting a force on a free end of the push bar (2) of the ejection mechanism, which actuates the push plate (5) to push the electrical card out of the shell (1).

16 Claims, 5 Drawing Sheets

EJECTION MECHANISM FOR ELECTRICAL CARD CONNECTOR

BACKGROUND OF THE INVENTION

The present invention relates to an ejection mechanism for ejecting an electrical card from an electrical card connector, and particularly to an ejection mechanism which has a limited height to achieve a low profile electrical card connector.

As computer technology develops, portable computers, especially notebook computers are becoming increasingly popular. Light, thin, and compact notebook computers are especially in high demand in the market. All notebook computers include an electrical card connector expanding the memory and function thereof. Thus, an ejection mechanism for an electrical card connector having limited dimensions is requisite to promote conservation of space within the computer.

BRIEF SUMMARY OF THE INVENTION

A main object of the present invention is to provide an ejection mechanism for an electrical card connector for expediently ejecting an electrical card from the electrical card connector and which has a simplified structure and a limited height so that space on a circuit board can be saved.

To fulfill the above mentioned object, an ejection mechanism in accordance with the present invention comprises a shell, a push bar, a push plate and a connection bar. By pressing the push bar, the connection bar is driven to pivot about a positioning silo, and an electrical card is ejected from an electrical card connector by the push plate.

Other objects, advantages and novel features of the invention will become more apparent from the following detailed description when taken in conjunction with the accompanying drawings.

DETAILED DESCRIPTION OF THE INVENTION

Figure 1:
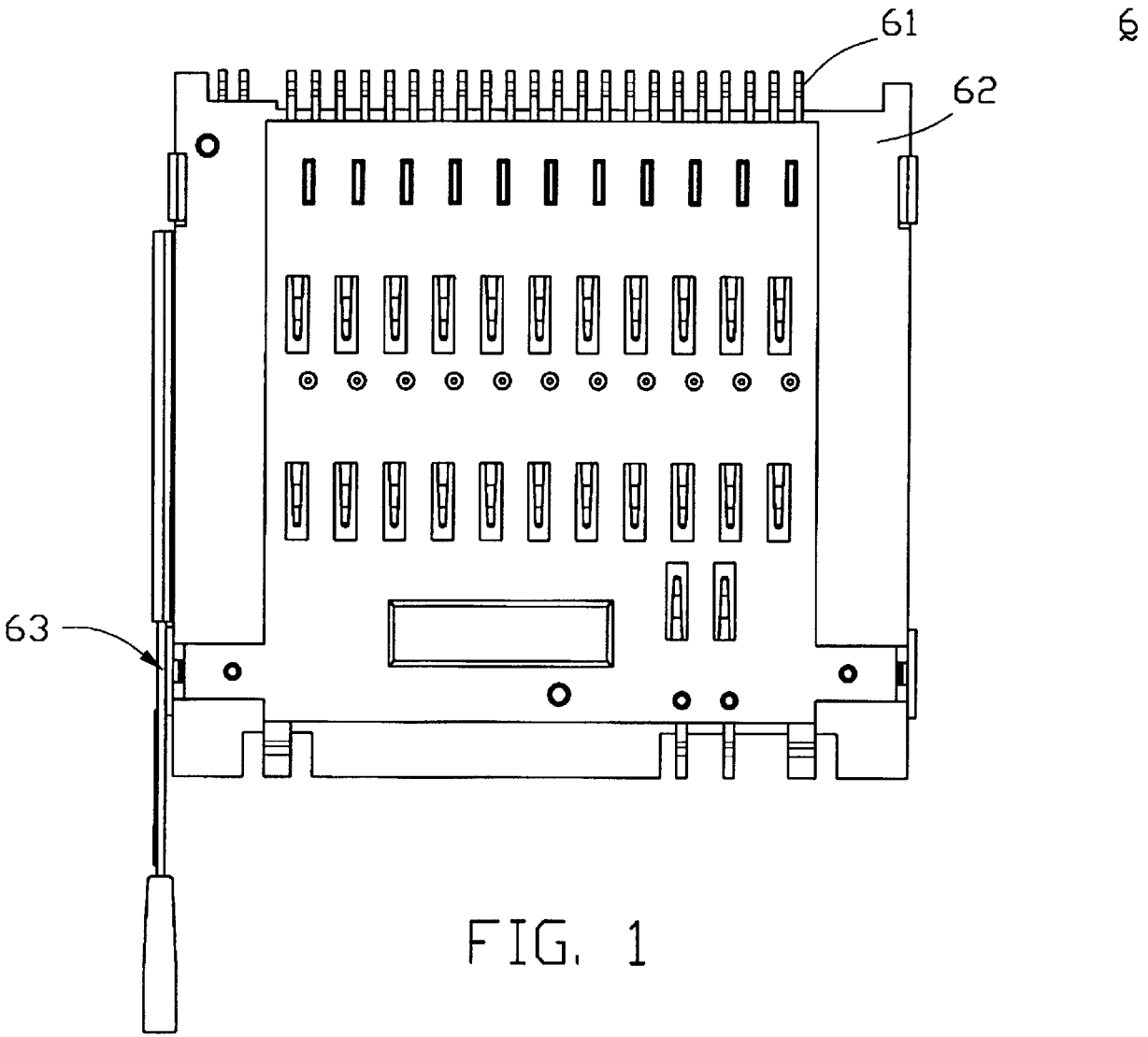
FIG. 1 is a bottom view of an electrical card connector.

Referring to FIG. 1, an electrical card connector 6 comprises a plurality of terminals 61, an insulative housing 62 and an ejection mechanism 63. The insulative housing 62 defines a plurality of passageways for receiving the terminals 61, and the terminals 61 will contact an inserted electrical card (not shown).

Figure 2:
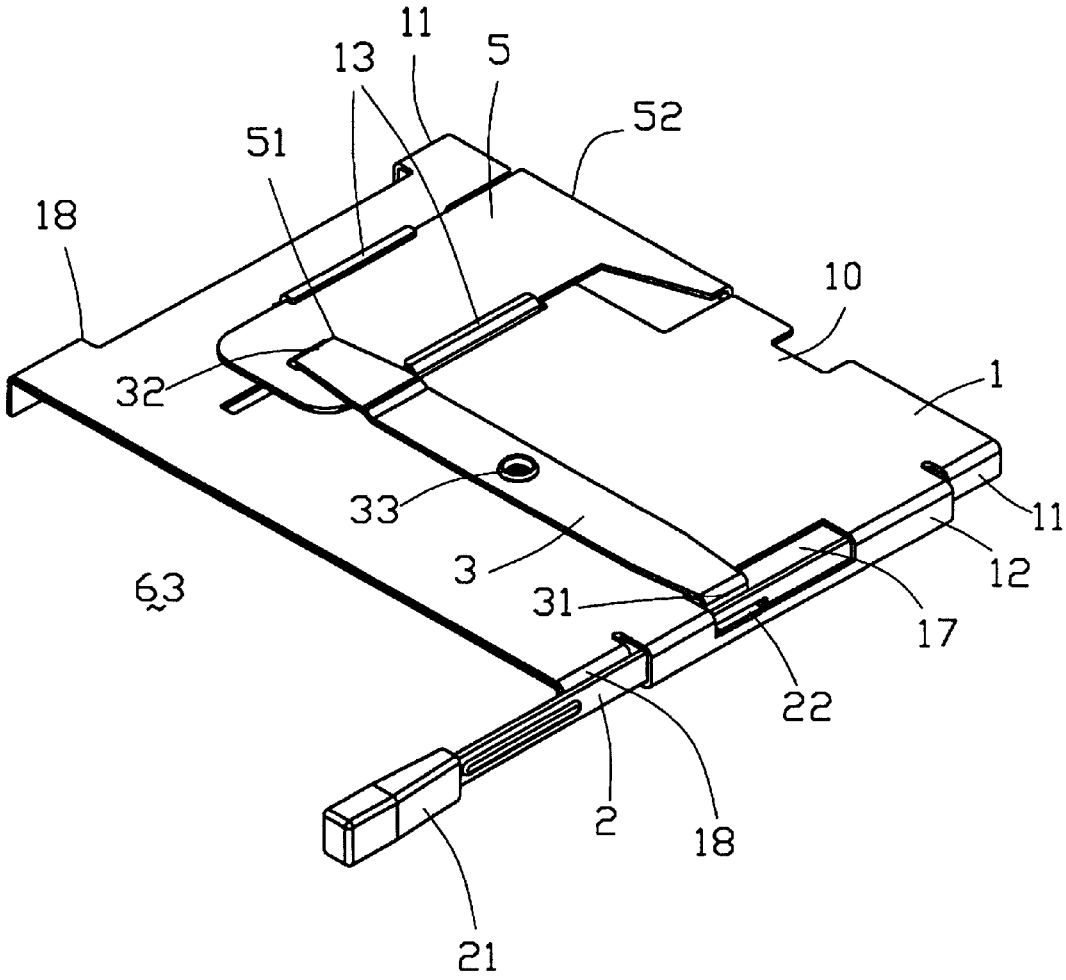
FIG. 2 is a perspective view of an ejection mechanism in accordance with the present invention.
Figure 3:
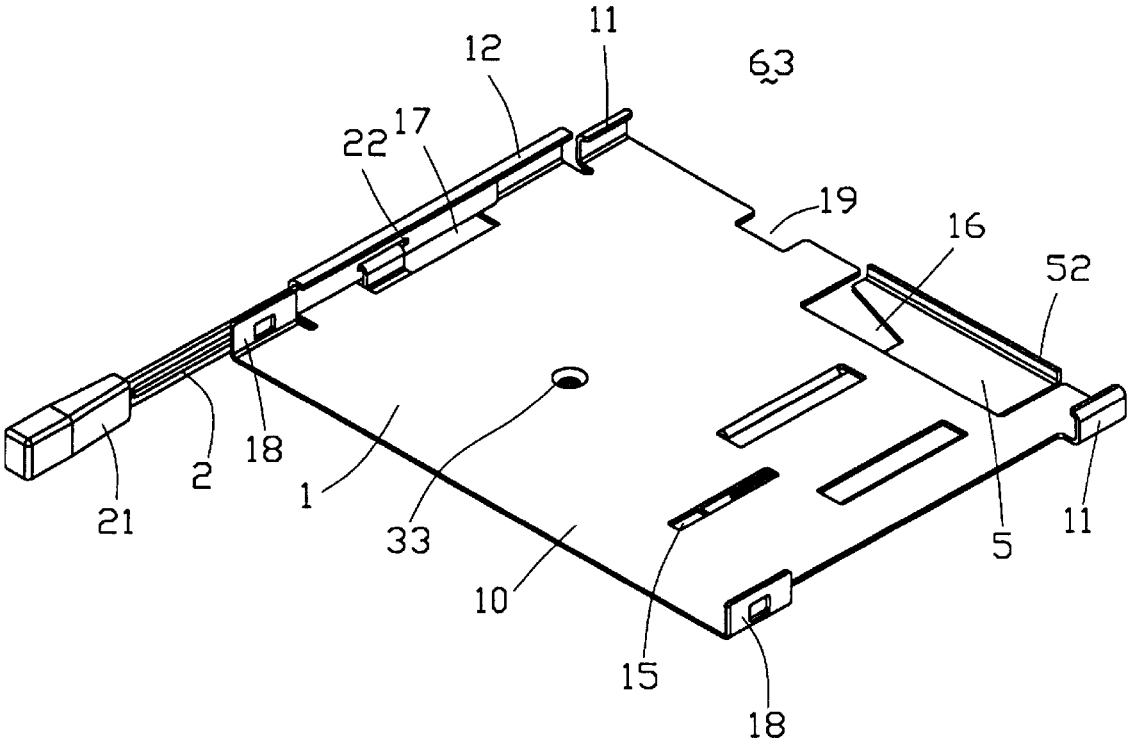
FIG. 3 is a bottom view of the ejection mechanism.
Figure 4:
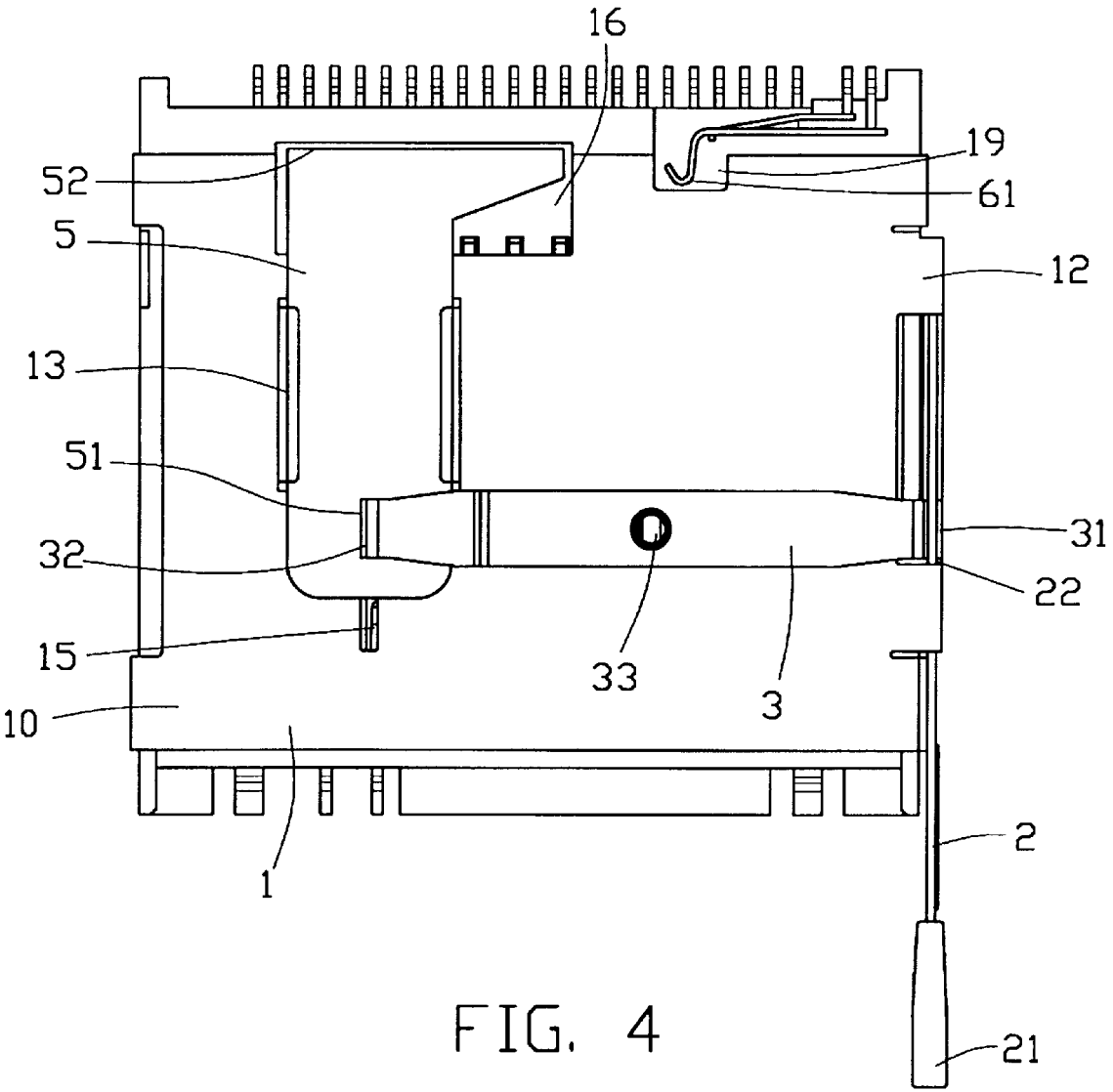
FIG. 4 is a top view of the ejection mechanism.

Referring to FIGS. 2 and 3, the ejection mechanism 63 comprises a shell 1, a push bar 2, a connection plate 3 and a push plate 5. The shell 1, the connection plate 3 and the push plate 5 are each formed by stamping a metal sheet, so that they generally have a same thickness. The shell 1 has a base 10. A pair U-shaped engaging arms 11 and a pair of locking elements 18 extend from lateral edges of the base 10 for receiving an electrical card (not shown) therebetween. A folded frame 12 extends from one edge of the base 10 and forms a channel (not shown). A pair of leading rails 13 is formed in the base 10 for retaining the push plate 5 therebetween. A first cutout 16 is formed in the base 10 for receiving a push section 52. A second cutout 19 is formed in the base 10 proximate the first cutout 16 for receiving the terminals 61 (FIG. 4). First and second leading slots 17, 15 are formed in the base 10 for respectively receiving first and second ends 31, 32 of the connection plate 3. A positioning silo 33 is formed in the base 10 and connects with the connection plate 3 for controlling movement of the connection plate 3.

The push bar 2 is received in the channel of the folded frame 12 of the base 10 and connects with the first end 31 of the connection plate 3 by an engaging slot 22 defined therein. The first end 31 of the connection plate 3 is L-shaped for engaging with the engaging slot 22, and the second end 32 is U-shaped for engaging with the second leading slot 15 of the base 10 through a narrow slot 51 of the push plate 5. The push plate 5 is received between the leading rails 13, and the push section 52 is formed at one end of the push plate 5 for contacting an inserted electrical card. The push plate 5 is driven by the second end 32 of the connection plate 3, and the leading slot 15 controls the movement thereof.

Figure 5:
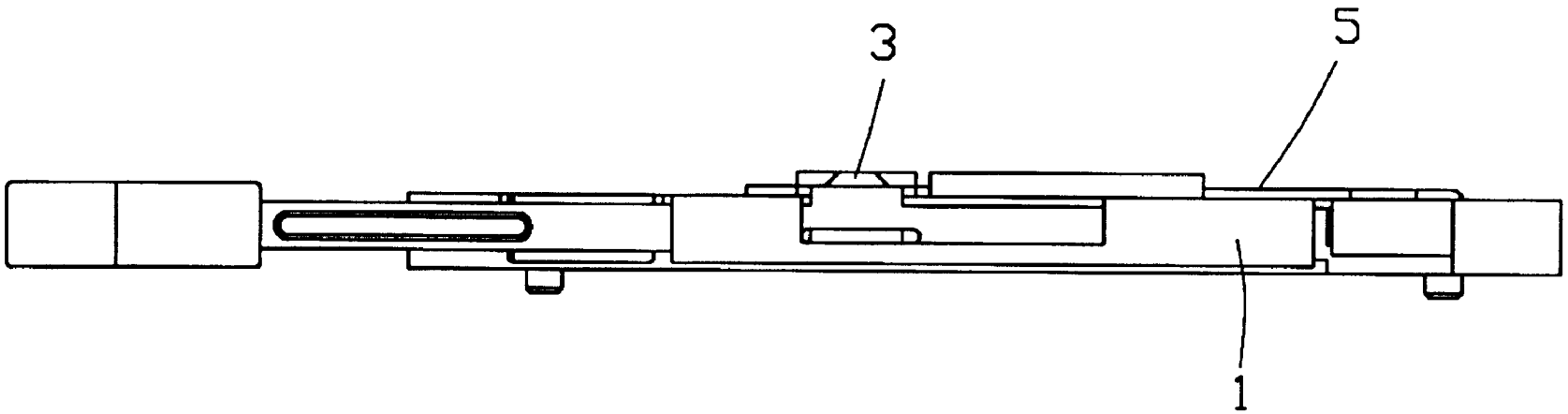
FIG. 5 is a side view of the electrical card connector.

Referring to FIGS. 4 and 5, by exerting a force on a free end 21 of the push bar 2, the engaging slot 22 will also move, and the first end 31 of the connection plate 3 is driven thereby. The push plate 5 is driven by the second end 32 of the connection plate 3, and an inserted electrical card will be withdrawn by the push section 52. Thus, an electrical card can be easily ejected from the electrical card connector.

In the present invention, the height of the ejection mechanism 63 is minimized and therefore the height of electrical card connector 6 can be conserved comparing to conventional design. In particular, the push plate 5 and the connection plate 3 are so designed that the three thickest portions of the ejection mechanism 63, namely the positioning silo 33, the second end 32 of the connection plate 3 and the leading rails 13 as measured from the side of the shell seen in FIG. 2, all have a thickness substantially equal to three times of the sheet metal thickness. Thus, the present invention provides a design for ejecting an electrical card from an electrical card connector which can be easily assembled and which promotes a conservation of space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An ejection mechanism for an electrical card connector, comprising:

a shell comprising a base forming a pair of leading rails on a top surface thereof and a folded frame extending from an edge of the base to form a channel;

a push bar being received in the channel of the shell;

a push plate being slidably received between the leading rails of the base of the shell and having a push section for ejecting an electrical card; and a connection plate being rotatably connected to the base of the shell, the connection plate comprising a first end connected with the push bar and a second end connected with the push plate.

2. The ejection mechanism as claimed in claim 1, wherein the push bar has an engaging slot for receiving the first end of connection plate.

3. The ejection mechanism as claimed in claim 1, wherein a cutout is formed in an edge of the base for receiving the push section therein and the push section is formed at one end of the push plate for contacting an inserted electrical card.

4. The ejection mechanism as claimed in claim 1, wherein a first and a second leading slots are formed in the base for respectively receiving first and second ends of the connection plate and a positioning silo is formed in the base through the connection plate for permitting a rotatable movement of the connection plate with respect to the base.

5. The ejection mechanism as claimed in claim 1, wherein two ends of the push plate have a different width and the push section is formed at the wider end.

6. An electrical card connector comprising:

an insulative housing forming a plurality of passageways receiving terminals therein; and an ejection mechanism comprising a shell affixed to one side of the housing, a pair of engaging arms and a pair of locking elements integrally formed with the shell, a push bar mounted to a side edge of the shell, leading rails being formed on a top surface of the shell, a connection plate rotatably connected to the shell and a push plate slidably received between the leading rails of the shell, the engaging arms and the locking elements being secured to the housing, the push bar being slidably connected with a first end of the connection plate and the push plate being connected with an opposite second end of the connection plate, the push bar being operable to turn the connection plate to thereby move the push plate.

7. The electrical card connector as claimed in claim 6, wherein the push plate is moveable by the connection plate to eject an electrical card inserted between the housing and the shell.

8. The electrical card connector as claimed in claim 6, wherein the push bar has an engaging slot for receiving the first end of the connection plate.

9. The electrical card connector as claimed in claim 6, wherein a cutout is formed in an edge of the shell and a push section is formed at one end of the push plate, the push section being freely moveable in the cutout.

10. The electrical card connector as claimed in claim 9, wherein the push plate has a front and a rear ends of different width and the push section is formed at the rear wider end.

11. The electrical card connector as claimed in claim 6, wherein a first and second leading slots are formed in the shell for respectively receiving the first and the second ends of the connection plate and a positioning silo is formed in the shell and connected with the connection plate.

12. An ejection mechanism for an electrical card connector, comprising:

a shell comprising a base and a folded frame extending from an edge of the base to form a channel, the base forming a first leading slot, a second leading slot and a positioning silo;

a push bar being received in the channel of the shell;

a push plate being slidably mounted to the base of the shell and having a push section for ejecting an electrical card; and a connection plate being rotatably connected to the positioning silo of the base of the shell, the connection plate comprising a first end received in the first leading slot of the base and connected with the push bar and a second end received in the second leading slot of the base and connected with the push plate.

13. The ejection mechanism as claimed in claim 12, wherein a pair of leading rails is formed on a top surface of the shell for receiving the push plate therebetween.

14. The ejection mechanism as claimed in claim 12, wherein a cutout is formed in an edge of the base for receiving the push section therein and the push section is formed at one end of the push plate for contacting an inserted electrical card.

15. The ejection mechanism as claimed in claim 12, wherein two ends of the push plate have a different width and the push section is formed at the wider end.

16. An electrical card connector comprising:

an insulative housing forming a plurality of passageways receiving terminals therein; and an ejection mechanism comprising a shell affixed to one side of the housing, a pair of engaging arms and a pair of locking elements integrally formed with the shell, a push bar mounted to a side edge of the shell, a connection plate rotatably connected to the shell and a push plate slidably mounted to the shell, the engaging arms and the locking elements being secured to the housing, the push bar being slidably connected with a first end of the connection plate and the push plate being connected with an opposite second end of the connection plate, the push bar being operable to turn the connection plate to thereby move the push plate; wherein first and second leading slots are formed in the shell for respectively receiving the first and the second ends of the connection plate and a positioning silo is formed in the shell and connected with the connection plate.

* * * * *